US008425700B2

(12) United States Patent
DiSalvo

(10) Patent No.: US 8,425,700 B2
(45) **Date of Patent: *Apr. 23, 2013**

(54) HIGH ENERGY, LOW TEMPERATURE GELLED BI-PROPELLANT FORMULATION PREPARATION METHOD

(75) Inventor: Roberto DiSalvo, Madison, AL (US)

(73) Assignee: CFD Research Corporation, Huntsville, AL (US)

( * ) Notice: Subject to any disclaimer, the term of this patent is extended or adjusted under 35 U.S.C. 154(b) by 56 days.

This patent is subject to a terminal disclaimer.

(21) Appl. No.: 13/013,762

(22) Filed: Jan. 25, 2011

(65) Prior Publication Data

US 2012/0073713 A1 Mar. 29, 2012

Related U.S. Application Data

(62) Division of application No. 11/292,442, filed on Dec. 2, 2005, now Pat. No. 7,896,987.

(51) Int. Cl.
*C06B 45/00* (2006.01)

(52) U.S. Cl.
USPC ..... 149/1

(58) Field of Classification Search ..... 149/1; 60/204, 60/211
See application file for complete search history.

(56) References Cited

U.S. PATENT DOCUMENTS

| | | | | |
|---|---|---|---|---|
| 3,380,250 | A | 4/1968 | Whatley | |
| 4,499,723 | A | 2/1985 | Frankel et al. | |
| 5,288,915 | A | 2/1994 | Walters | |
| 5,438,824 | A * | 8/1995 | Asaoka et al. | 60/251 |
| 6,210,504 | B1 | 4/2001 | Thompson | |
| 2002/0196704 | A1 | 12/2002 | May | |
| 2003/0159811 | A1 | 8/2003 | Nurmi | |
| 2005/0158477 | A1 | 7/2005 | Vezin et al. | |

* cited by examiner

*Primary Examiner* — Aileen B Felton
(74) *Attorney, Agent, or Firm* — Maschoff Brennan

(57) ABSTRACT

A method for preparing a gelled liquid propane (GLP) composition comprises the introduction of liquid propane into an evacuated mixing vessel containing a gellant and mixing the liquid propane with the gellant. A bi-propellant system comprising GLP is particularly well-suited for outer planet missions greater than 3 AU from the sun and also functions in earth and near earth environments. Additives such as powders of boron, carbon, lithium, and/or aluminum can be added improve performance or enhance hypergolicity. The gelling agent can be silicon dioxide, clay, carbon, or organic or inorganic polymers. The bi-propellant system may be, but need not be, hypergolic.

20 Claims, 4 Drawing Sheets

HIGH ENERGY, LOW TEMPERATURE GELLED BI-PROPELLANT FORMULATION PREPARATION METHOD

CROSS-REFERENCE TO RELATED APPLICATIONS

This application is a divisional of U.S. patent application Ser. No. 11/292,442 filed Dec. 2, 2005. U.S. patent application Ser. No. 12/874,242. U.S. patent application Ser. No. 11/584,954, now U.S. Pat. No. 7,810,990, disclose related subject matter.

FEDERALLY SPONSORED RESEARCH OR DEVELOPMENT

The U.S. Government may have certain rights in this invention pursuant to SBIR Contract No. NNM05AA56C awarded by NASA.

BACKGROUND OF THE INVENTION

1. Field of the Invention

The present invention relates to a method for preparing rocket propellants. More specifically, the present invention is a method for preparing a low-storage temperature bipropellant combination that provides for reduced power budgets devoted to propellant warming and offers significant improvements in safety operations combined with high performance. This enables, for example, missions to the outer planets on lower power budgets than is currently possible. This propellant technology also has applications in upper stage orbital maneuvering requiring high-performance, low temperature bi-propellants.

2. Description of Related Art

As a spacecraft moves farther from the sun, less radiant heat is absorbed and the temperature within insulated fuel tanks decreases. Thermal Control Systems (TCSs) are required to prevent fuel and oxidizer from freezing when they are not in use and to heat them to operating temperatures between 16 and 26° C. before use. For distances from the sun greater than 3 AU, the portion of the power budget consumed by heaters to prevent propellant freezing increases significantly.

With planned missions demanding more science for less money, the power budget necessary for propellant heating must be minimized to avoid limiting mission objectives. There is, therefore, a need for propellants having very low freezing and operating temperatures. Fuels and oxidizers having low freezing points such as Liquid Hydrogen (LH) and liquid Oxygen (LOX) are not suitable for use on planetary probes because they require cryogenic storage vessels capable of containing them within several AU of the sun. Propane is a gaseous hydrocarbon that readily liquefies by compression and cooling, melts at −189.9° C. and boils at −42.2° C. These physical properties make it a potential low-temperature propellant. MON (mixed oxides of nitrogen) is a solution of nitric oxide (NO) in dinitrogen tetroxide/nitrogen dioxide (NTO). MON propellants are used oxidizers on some military and commercial satellites. The freezing points of existing MONs are not low enough to be ideal candidates for use on deep space missions.

Gelling of rocket propellants has been accepted in the last decade as a method of improving performance and reducing environmental impact. For example, U.S. Pat. No. 6,013,143 (Thompson) discloses hypergolic fuel bipropellants containing inhibited red fuming nitric acid (IRFNA), nitrogen tetroxide (NTO), hydrogen peroxide, and hydroxyl ammonium nitrate oxidizers and monomethyl hydrazine (MMH), dimethylaminoethylazide, pyrollidinylethylazide, bis(ethyl azide) methylamine fuels gelled with silicon dioxide, clay, carbon, or polymers. U.S. Pat. No. 6,165,293 (Allan) discloses a thixotropic IRFNA gel oxidizer for use in hypergolic fuel bipropellants. U.S. Pat. No. 6,652,682 (Fawls) discloses gelled bipropellants doped with nano-sized boron particles.

The above patents disclose gelled propellants having improved safety and reduced environmental hazards compared to non-gelled propellants. The gelling of propellants to lower freezing points, operating temperatures, vapor pressures, or tankage weights is not disclosed.

BRIEF SUMMARY OF THE INVENTION

The present invention is a method for preparing a bi-propellant system comprising gelled liquid propane (GLP) fuel. The bi-propellant system is particularly well-suited for outer planet missions but also functions in near earth environments. Additives such as powders of boron, carbon, lithium, and/or aluminum can be added to the fuel component to improve performance or enhance hypergolicity. The gelling agent can be silicon dioxide, clay, carbon, or organic or inorganic polymers. The bi-propellant system may be, but need not be, hypergolic.

DETAILED DESCRIPTION OF THE INVENTION

The present invention is a method for preparing a bipropellant formulation comprising a gelled liquid propane (GLP) fuel component. The bipropellant system provides a vacuum specific impulse ($I_{sp,1000\text{-}vac}$) as high as 360 seconds. The energy density of the propulsion system can be further improved by adding an energetic additive, such as a submicron powder of boron, carbon, or aluminum to the fuel component. Increasing the density of the propellant through the addition of energetic powders also allows for higher thrust levels in volume-limited propulsion systems. Although applicable in many operational environments, the formulation is particularly useful for outer planetary missions because of the very low freezing points and operational temperatures of the fuel and oxidizer.

Liquid MON propellants of up to 25% NO (75% $N_2O_4$+25% NO) are sometimes used as oxidizers on military and commercial satellites. The non-gelled form of the invented oxidizer is MON-30 (70% $N_2O_4$+30% NO), which has a freezing point of −16.1° C., or 7.1° C. lower than MON-25. Gelling of MON-30, in addition to the well-known safety benefits, reduces the possibility of combustion instability, seen in some MON systems, where the nitric oxide (NO) can flash at the injector face. Most importantly, gelling MON-30 reduces the freezing point relative to the liquid and lowers operational temperatures as well.

Propane, $CH_3CH_2CH_3$, is a gaseous hydrocarbon that readily liquefies by compression and cooling and melts at −189.9° C. and boils at −42.2° C. Gelling the propellant provides the advantage of higher volumetric efficiency.

Figure 1:
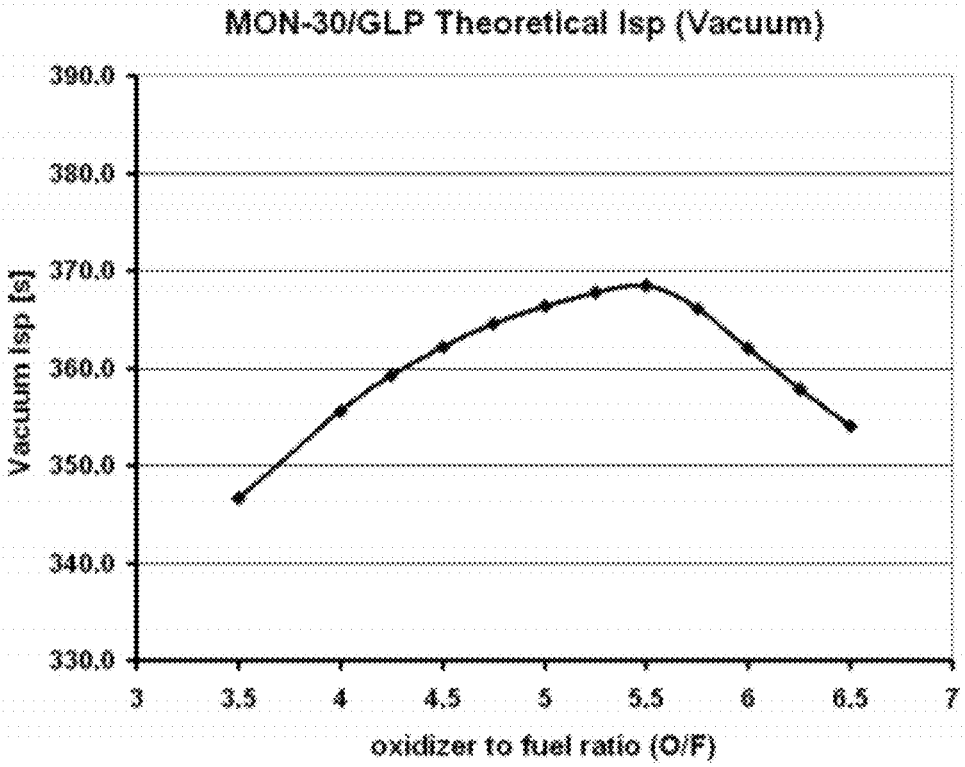
FIG. 1 Theoretical Vacuum Specific Impulse of gelled MON-30/gelled propane

To verify the ballistic properties of the gelled MON-30/GLP bi-propellant system, the vacuum specific impulse as a function of O/F ratio was computed and the results are plotted in FIG. 1. With a chamber pressure of 1,000 psia, an O/F ratio of 5.5, an expansion ratio of 300 can provide a maximum vacuum Isp of 368.4 seconds. This performance makes this propellant system fully competitive with current bi-propellant combinations such as NTO/MMH.

LP and MON-30 Gelling Apparatus and General Methods

MON-30 and GLP gelling/mixing can performed using a variety of devices, methods, and conditions. The following method and apparatus is provided as an example and it is understood by those skilled in the art that other methods of mixing may also be used. MON-30 and GLP are gelled using one-liter churn-mixers, each comprising a cylindrical vessel that is sealed by a piston-like closure-lid. A rod, attached externally to a pneumatic actuator, goes through the center of the closure-lid and attaches to a perforated churn-plate. The churn-plate has thirty-six, 6 mm diameter holes and is pneumatically cycled up and down, through the entire mixer volume, forcing the entire mass of liquid and gelling agents through the perforations with each half-cycle.

The mixing temperatures are around −20° C. for MON-30 and around −50° C. for LP. Gelling agents may include silicon dioxide, clay, carbon, organic or inorganic polymers, or combinations thereof. Generally, the % by weight of gelling agent used is the minimum required to achieve the desired physical properties. The amount of gallant used is preferably 1% to 12% by weight and most preferably 2% to 5% by weight. In one preferred embodiment, the gelling agent for MON-30 and LP is fumed silica. A small amount of polymeric agent, such as hydroxypropyl cellulose, may also be added to improve long-term storage characteristics. Surfactants may be used to improve the "wetting" of a gellant. Hypergolicity of the fuel may be increased including small amounts of Lithium metal, hydrogen gas, or MMH.

Synthesis and Gelling of MON-30

The oxidizer for the low-temperature propellant combination is MON-30. MONs are solutions of Nitric Oxide (NO) in Dinitrogen Tetroxide/Nitrogen Dioxide. The reaction that takes place as NO is added to $NO_2$ is shown below. The reaction is exothermic and releases 6000 kcal/kg.

$$NO+NO_2 \rightarrow N_2O_3$$

Figure 2:
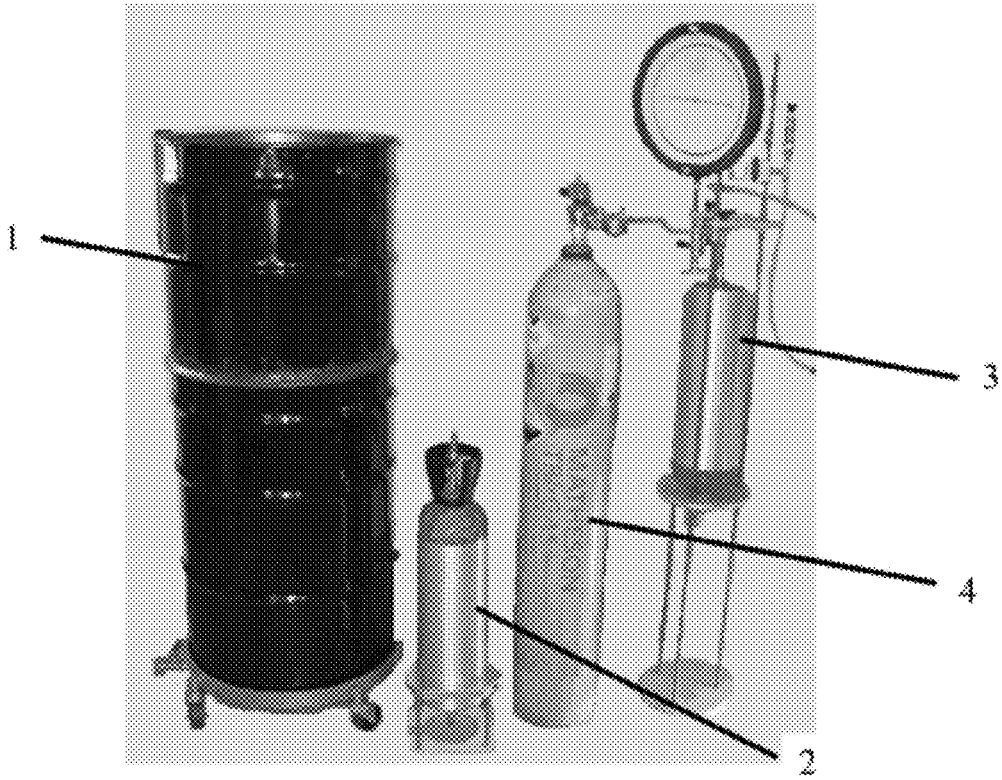
FIG. 2 Apparatus For Producing Mixed Oxides Of Nitrogen (MON)
Figure 3:
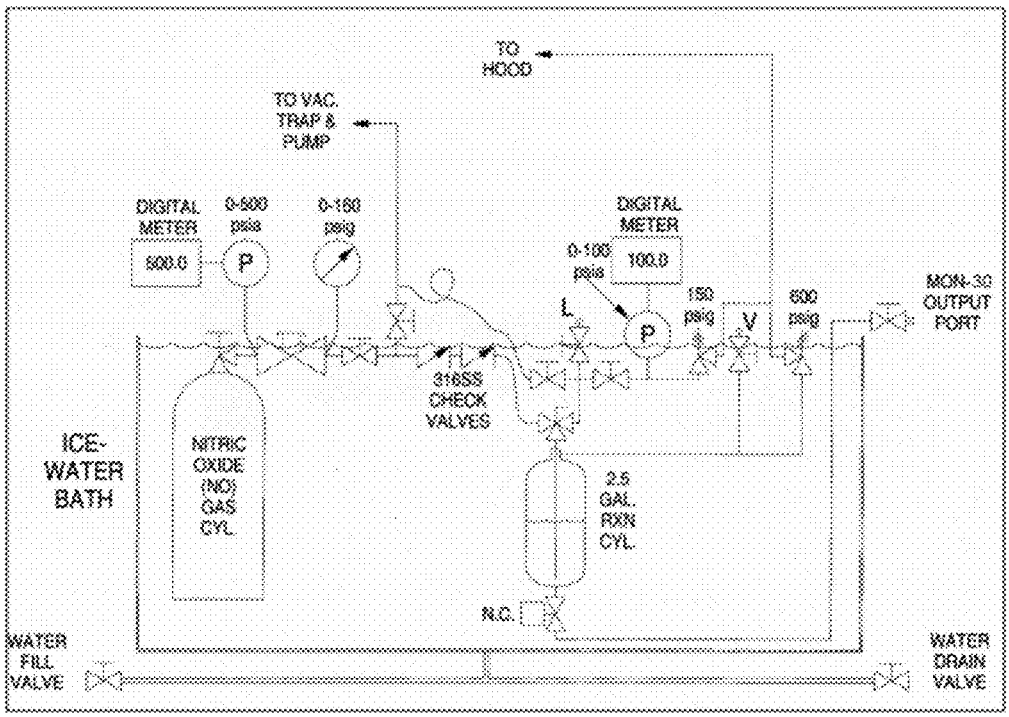
FIG. 3 Integrated System Diagram With The Various Components Identified

One type of apparatus that may be used to synthesize MON-30 is shown in FIG. 2 and comprises ice water bath 1, $NO_2$ transfer tank 2, reaction cylinder 3, and nitrous oxide tank 4. FIG. 3 shows a diagram of the integrated system with the various components identified. MON-30 was synthesized by applying a vacuum to all system hardware, feeding 500 g of liquid $NO_2$ into the reaction cylinder, and lowering the reaction cylinder apparatus and NO tank into the ice water bath to maintain the temperature of the reactants at 0° C. Once the pressure in the reaction cylinder and the NO bottle reach equilibrium, 214 g of NO was metered into the reaction cylinder.

The MON-30 was gelled at around −25° C. with 3% fumed silica by weight using a plate churn mixer. The mixture was churned for approximately 2 minutes. The gelled MON-30 has a freezing point of −81° C.

Gelling Liquid Propane

Figure 4:
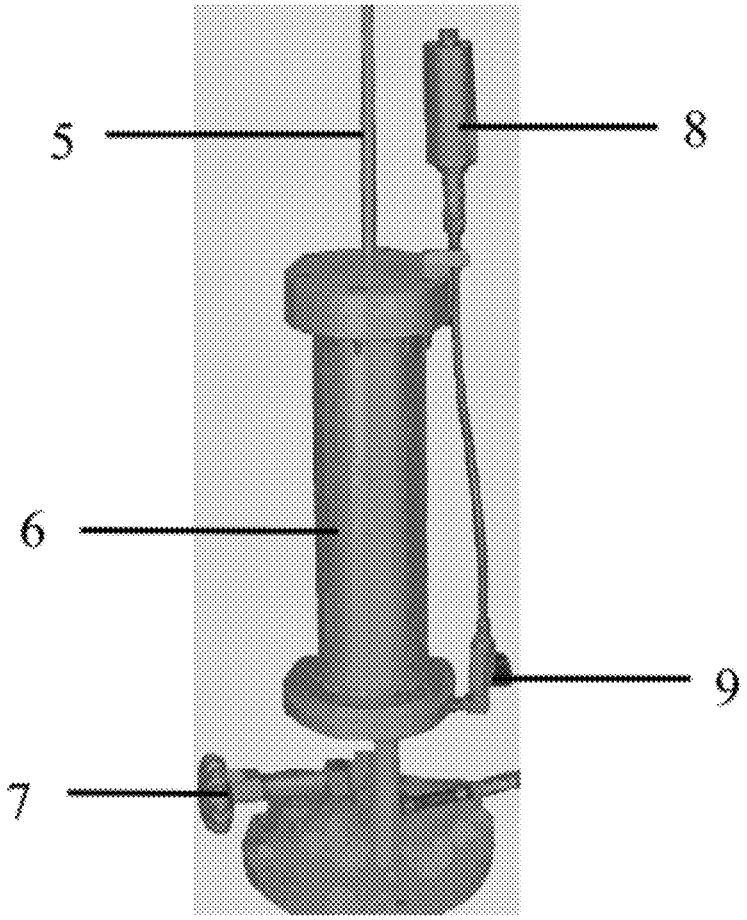
FIG. 4 Liquid propane gel mixer

Propane was gelled using a plate churn mixer shown in FIG. 4 placed inside an insulated polyethylene drum filled with a water-ethylene glycol mixture cooled to −55° C. Elements of the plate churn mixer shown in FIG. 4 are the mixer actuator rod 5, mixing/storage vessel 6, cryogenic valve 7, absolute pressure transducer 8, and pressure transducer disconnect valve 9. 20 grams of Cabot M-5® fumed silica were introduced into the mixing vessel. After addition of the silica, the vessel was attached to a vacuum pump, evacuated, and cooled in dry ice for 10 minutes. 500 grams of liquid propane was introduced into the mixing vessel. For the churning phase, the system was submerged in a 70/30-ethylene glycol/water bath and cooled to −55° C. Once the mixing vessel pressure reached approximately 8 psia, the mixture was churned for approximately 2 minutes. The gelled propane has a freezing point of −189.9° C.

What is claimed is:

1. A method for gelling propane comprising:

a. placing a gellant in a mixing vessel, b. applying a vacuum to the mixing vessel, c. introducing liquid propane to the mixing vessel, d. cooling the mixing vessel to a temperature of less than −30° C., and e. mixing the gellant with the liquid propane to produce gelled liquid propane.

2. The method of claim 1, wherein the gellant is selected from the group consisting of silicon dioxide, clay, carbon, an organic polymer, and an inorganic polymer.

3. The method of claim 1, wherein the gellant is fused silica.

4. The method of claim 1, wherein the mixing vessel is a churn mixer.

5. The method of claim 1, wherein the temperature to which the mixing vessel is cooled is −55° C.

6. The method of claim 2, wherein the gellant comprises 3% to 5% of the gelled liquid propane by weight.

7. The method of claim 1, and further comprising the step of placing an additive selected from hydrogen gas, lithium metal, monomethyl hydrazine, a surfactant, hydroxypropyl cellulose, carbon, aluminum, and boron into the mixing vessel.

8. The method of claim 1, wherein the gelled liquid propane is a thixotropic gel.

9. The method of claim 1, comprising adding a powder to the mixing vessel, the powder being selected from boron, carbon, lithium, aluminum and combinations thereof.

10. The method of claim 1, comprising preparing the gelled liquid propane to be hypergolic.

11. The method of claim 1, comprising cooling the mixing vessel to a temperature of about −55° C.

12. The method of claim 1, wherein the gellant is fumed silica.

13. The method of claim 1, comprising increasing hypergolicity of the fuel by adding lithium metal, hydrogen gas, or monomethyl hydrazine.

14. The method of claim 1, comprising preparing the gelled propane to have a freezing point of about −189.9° C.

15. The method of claim 1, comprising increasing pressure in the mixing vessel before or during the mixing.

16. The method of claim 15, comprising increasing the pressure to about 8 psia.

17. The method of claim 15, comprising mixing after increasing the pressure.

18. The method of claim 16, comprising mixing after increasing the pressure.

19. A method for gelling propane comprising:

placing a gellant in a mixing vessel, applying a vacuum to the mixing vessel, introducing liquid propane to the mixing vessel, cooling the mixing vessel to a temperature of about −55° C., and mixing the gellant with the liquid propane to produce gelled liquid propane.

20. The method of claim 19, wherein the gellant is selected from the group consisting of silicon dioxide, clay, carbon, an organic polymer, fused silica, fumed silica, and an inorganic polymer.

* * * * *